US011649737B2

(12) United States Patent
McGinnis et al.

(10) Patent No.: US 11,649,737 B2
(45) Date of Patent: May 16, 2023

(54) FORGED CAST FORGED OUTER CASE FOR A GAS TURBINE ENGINE

(71) Applicant: Raytheon Technologies Corporation, Farmington, CT (US)

(72) Inventors: Christine F. McGinnis, New Britain, CT (US); Steven J. Bauer, East Haddam, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 350 days.

(21) Appl. No.: 17/103,153

(22) Filed: Nov. 24, 2020

(65) Prior Publication Data

US 2021/0079813 A1 Mar. 18, 2021

Related U.S. Application Data

(63) Continuation of application No. 14/948,768, filed on Nov. 23, 2015, now abandoned.

(60) Provisional application No. 62/083,968, filed on Nov. 25, 2014.

(51) Int. Cl.

| | |
|---|---|
| ***F01D 25/24*** | (2006.01) |
| ***F01D 25/26*** | (2006.01) |
| ***F01D 21/04*** | (2006.01) |

(52) U.S. Cl.

CPC ..... *F01D 25/26* (2013.01); *F01D 21/045* (2013.01); *F01D 25/24* (2013.01); *F05D 2220/32* (2013.01); *F05D 2230/21* (2013.01); *F05D 2230/232* (2013.01); *F05D 2230/25* (2013.01); *F05D 2240/14* (2013.01); *F05D 2300/175* (2013.01)

(58) Field of Classification Search

CPC ..... F01D 25/24; F01D 25/26; F01D 21/045; F05D 2220/32; F05D 2230/21; F05D 2230/25; F05D 2240/14

See application file for complete search history.

(56) References Cited

U.S. PATENT DOCUMENTS

| | | | | |
|---|---|---|---|---|
| 5,605,438 | A | 2/1997 | Burdgick | |
| 8,061,969 | B2 | 11/2011 | Durocher et al. | |
| 8,091,371 | B2 | 1/2012 | Durocher et al. | |
| 8,099,962 | B2 | 1/2012 | Durocher et al. | |
| 8,245,518 | B2 | 8/2012 | Durocher et al. | |
| 8,347,500 | B2 | 1/2013 | Durocher et al. | |
| 8,347,635 | B2 | 1/2013 | Durocher et al. | |
| 8,397,383 | B2 | 3/2013 | Barnett et al. | |
| 8,403,626 | B2 | 3/2013 | Hasselqvist et al. | |
| 8,408,011 | B2 | 4/2013 | Fontaine et al. | |
| 8,408,446 | B1 | 4/2013 | Smoke et al. | |
| 8,826,669 | B2 | 9/2014 | Bouchard et al. | |
| 9,803,501 | B2 * | 10/2017 | Wang | F02C 7/18 |

(Continued)

FOREIGN PATENT DOCUMENTS

WO 2013095202 A1 6/2013

OTHER PUBLICATIONS

EP Search Report dated Apr. 8, 2016 issued for corresponding European Patent Application No. 15196010.1.

*Primary Examiner* — Igor Kershteyn

(74) *Attorney, Agent, or Firm* — Bachman & LaPointe, P.C.

(57) ABSTRACT

A case for a gas turbine engine includes a cast case section cast case section configured to be welded between a forward case section and an aft case section.

16 Claims, 8 Drawing Sheets

(56) References Cited

U.S. PATENT DOCUMENTS

| | | | | |
|---|---|---|---|---|
| 10,087,782 | B2 * | 10/2018 | Wang | F01D 9/041 |
| 10,273,812 | B2 * | 4/2019 | Huppe | F02C 7/18 |
| 11,466,590 | B1 * | 10/2022 | St-Laurent | F01D 25/12 |
| 2005/0022501 | A1 * | 2/2005 | Eleftheriou | F01D 25/162 60/226.1 |
| 2008/0086881 | A1 | 4/2008 | Eleftheriou et al. | |
| 2008/0260529 | A1 | 10/2008 | Kawakami | |
| 2016/0108748 | A1 * | 4/2016 | Harris | F01D 9/042 415/177 |
| 2021/0140344 | A1 * | 5/2021 | Lefebvre | F01D 25/18 |

* cited by examiner

FORGED CAST FORGED OUTER CASE FOR A GAS TURBINE ENGINE

CROSS REFERENCE TO RELATED APPLICATION

The instant application is a continuation application of U.S. patent application Ser. No. 14/948,768, filed Nov. 23, 2015, which claims the benefit of provisional application Ser. No. 62/083,968, filed Nov. 25, 2014.

BACKGROUND

The present disclosure relates to a gas turbine engine and, more particularly, to a case therefore.

A Mid Turbine Frame (MTF) of a gas turbine engine typically includes a plurality of hollow vanes arranged in a ring-vane-ring structure. The rings define inner and outer boundaries of a core gas path while the vanes are disposed across the gas path. Tie rods extend through the hollow vanes to interconnect an engine mount ring and a bearing compartment. The MTF is subject to thermal stresses from combustion gases along the core gas path, which may reduce operational life thereof.

The MTF, sometimes referred to as an inter-turbine frame, is located generally between a high pressure turbine stage and a low pressure turbine stage of a gas turbine engine to support one or more bearings and to transfer bearing loads through to an outer engine case. The MTF system is thus a load bearing structure that provides rotor containment in the unlikely event a turbine shaft shear event should occur. The MTF is typically a forged structure that requires high strength for containment, and relatively significant machining to minimize weight and provide effective interfaces for various attachments.

SUMMARY

A case assembly for a gas turbine engine according to one disclosed non-limiting embodiment of the present disclosure includes a cast case section cast case section configured to be welded between a forward case section and an aft case section.

A further embodiment of the present disclosure includes, wherein the cast case section includes a machined interface.

A further embodiment of any of the foregoing embodiments of the present disclosure includes, wherein the cast case section includes a raised boss.

A further embodiment of any of the foregoing embodiments of the present disclosure includes, wherein the cast case section includes a machined surface.

A further embodiment of any of the foregoing embodiments of the present disclosure includes, wherein the forward case section and the aft case section are forged.

A further embodiment of any of the foregoing embodiments of the present disclosure includes, wherein the forged forward case section is configured for containment of a high pressure turbine rotor stage.

A further embodiment of any of the foregoing embodiments of the present disclosure includes, wherein the forged forward case section includes a forward flange.

A further embodiment of any of the foregoing embodiments of the present disclosure includes, wherein the forged aft case section is configured for containment of a low pressure turbine rotor stage.

A further embodiment of any of the foregoing embodiments of the present disclosure includes, wherein the forged aft case section includes an aft flange.

A further embodiment of any of the foregoing embodiments of the present disclosure includes, wherein the forged forward case section and the forged aft case section define respective forward and aft containment zones.

A further embodiment of any of the foregoing embodiments of the present disclosure includes, wherein the forged forward case section and the forged aft case section define respective forward and aft containment zones.

A further embodiment of any of the foregoing embodiments of the present disclosure includes, further comprising a forward weld between the forged forward case section and the cast case section outside of the forward containment zone and an aft weld between the cast case section and the forged aft case section outside of the aft containment zone.

A further embodiment of any of the foregoing embodiments of the present disclosure includes, wherein the case is a mid-turbine frame.

A further embodiment of any of the foregoing embodiments of the present disclosure includes, wherein the cast case section contains Inconel 718.

A case assembly for a gas turbine engine according to a another disclosed non-limiting embodiment of the present disclosure includes a forged forward case section that defines a forward containment zone around an axis; a forged aft case section that defines an aft containment zone around the axis; and a cast case section around the axis, the cast case section welded to the forged forward case section and the forged aft case section.

A further embodiment of any of the foregoing embodiments of the present disclosure includes, wherein the cast case section including a multiple of bosses.

A further embodiment of any of the foregoing embodiments of the present disclosure includes, wherein the cast case section includes an interface.

A further embodiment of any of the foregoing embodiments of the present disclosure includes, wherein the cast case section includes a raised boss.

A further embodiment of any of the foregoing embodiments of the present disclosure includes, wherein the cast case section includes a machined surface.

A further embodiment of any of the foregoing embodiments of the present disclosure includes, wherein the cast case section is manufactured of a lower strength but equivalent alloy of the forged forward case section and the forged aft case section.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
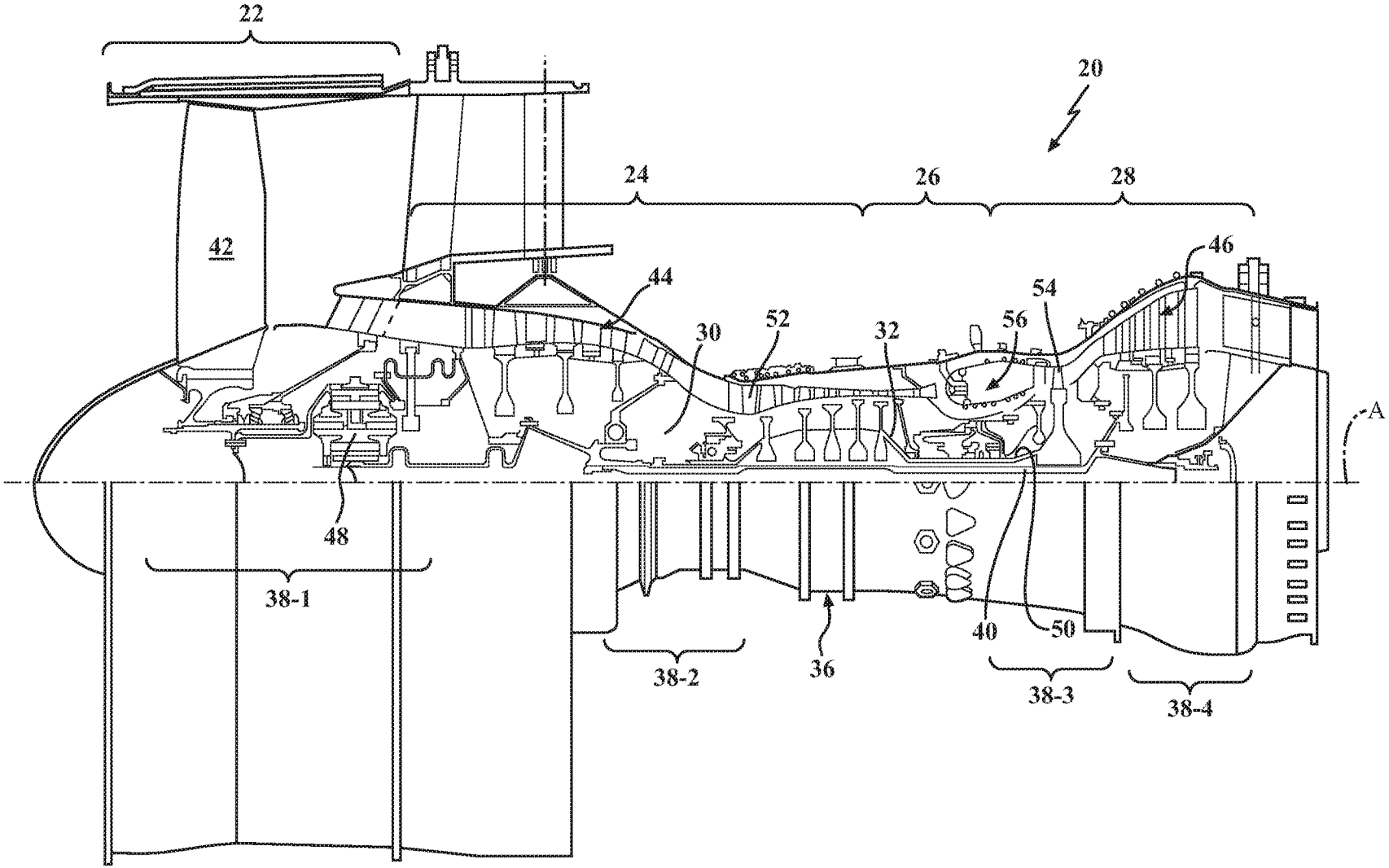
FIG. 1 is a schematic cross-sectional view of a geared architecture gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines architectures such as a low-bypass turbofan may include an augmentor section (not shown) among other systems or features. Although schematically illustrated as a turbofan in the disclosed non-limiting embodiment, it should be understood that the concepts described herein are not limited to use with turbofans as the teachings may be applied to other types of turbine engines to include but not limited to a three-spool (plus fan) engine wherein an intermediate spool includes an intermediate pressure compressor (IPC) between a low pressure compressor and a high pressure compressor with an intermediate pressure turbine (IPT) between a high pressure turbine and a low pressure turbine as well as other engine architectures such as turbojets, turboshafts, open rotors and industrial gas turbines.

The fan section 22 drives air along a bypass flowpath and a core flowpath while the compressor section 24 drives air along the core flowpath for compression and communication into the combustor section 26 then expansion through the turbine section 28. The engine 20 generally includes a low spool 30 and a high spool 32 mounted for rotation about an engine central longitudinal axis A relative to an engine case assembly 36 via several bearing compartments 38-1, 38-2, 38-3, 38-4. The bearing compartments 38-1, 38-2, 38-3, 38-4 in the disclosed non-limiting embodiment are defined herein as a forward bearing compartment 38-1, a mid-bearing compartment 38-2 axially aft of the forward bearing compartment 38-1, a mid-turbine bearing compartment 38-3 axially aft of the mid-bearing compartment 38-2 and a rear bearing compartment 38-4 axially aft of the mid-turbine bearing compartment 38-3 It should be appreciated that additional or alternative bearing compartments may be provided.

The low spool 30 generally includes an inner shaft 40 that interconnects a fan 42, a low-pressure compressor ("LPC") 44 and a low-pressure turbine ("LPT") 46. The inner shaft 40 drives the fan 42 through a geared architecture 48 to drive the fan 42 at a lower speed than the low spool 30. The high spool 32 includes an outer shaft 50 that interconnects a high-pressure compressor ("HPC") 52 and high-pressure turbine ("HPT") 54. A combustor 56 is arranged between the HPC 52 and the HPT 54. The inner shaft 40 and the outer shaft 50 are concentric and rotate about the engine central longitudinal axis A that is collinear with their longitudinal axes.

Core airflow is compressed by the LPC 44 then the HPC 52, mixed with the fuel and burned in the combustor 56, then expanded over the HPT 54 and the LPT 46. The HPT 54 and the LPT 46 drive the respective high spool 32 and low spool 30 in response to the expansion.

In one example, the gas turbine engine 20 is a high-bypass geared architecture engine in which the bypass ratio is greater than about six (6:1). The geared architecture 48 can include an epicyclic gear system 58, such as a planetary gear system, star gear system or other system. The example epicyclic gear train has a gear reduction ratio of greater than about 2.3, and in another example is greater than about 2.5 with a gear system efficiency greater than approximately 98%. The geared turbofan enables operation of the low spool 30 at higher speeds which can increase the operational efficiency of the LPC 44 and LPT 46 and render increased pressure in a fewer number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one non-limiting embodiment, a significant amount of thrust is provided by the bypass flow due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one non-limiting embodiment of the example gas turbine engine 20 is less than about 1150 fps (351 m/s).

Figure 2:
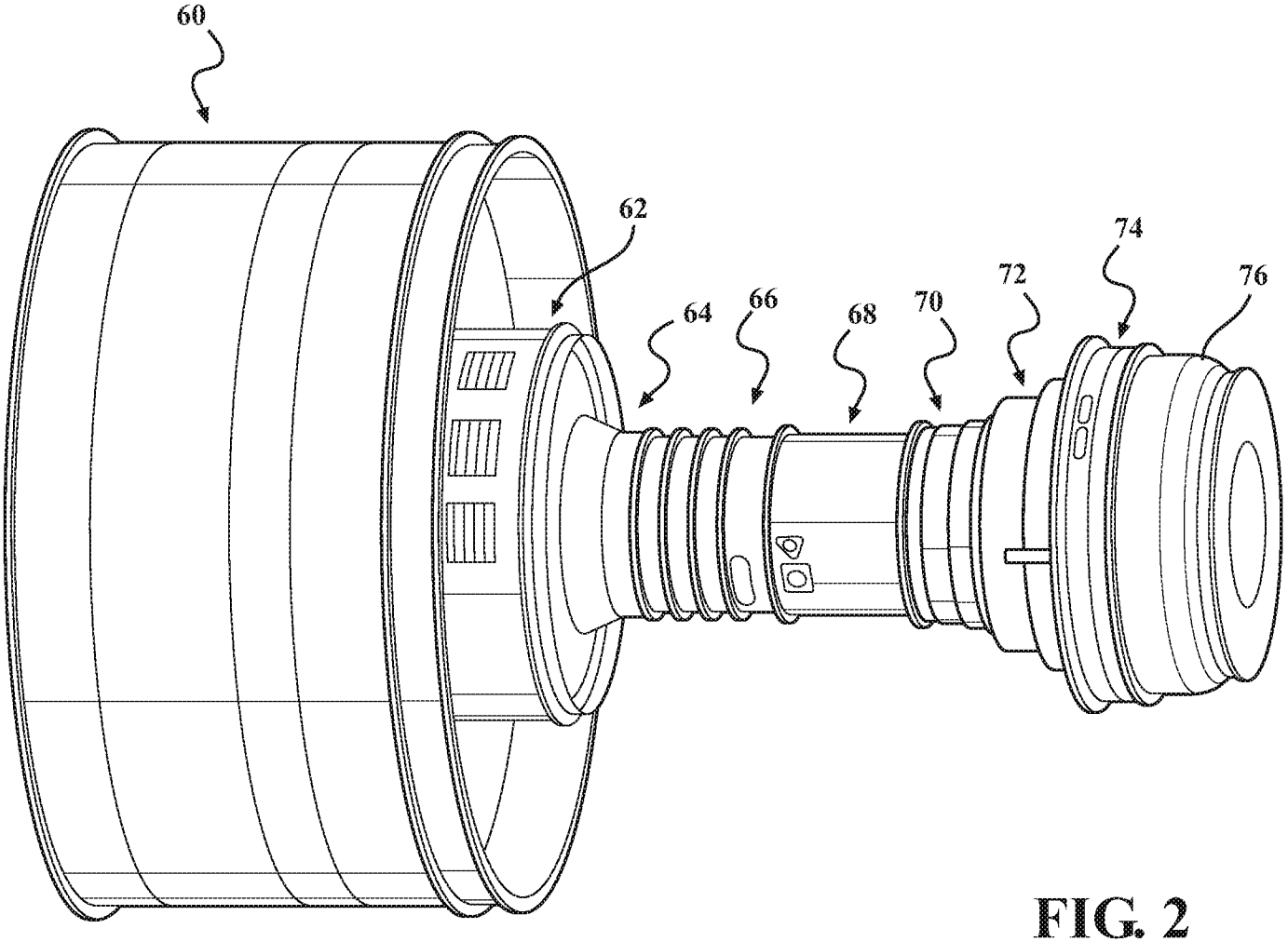
FIG. 2 is a perspective view of the engine modules of the engine.

With reference to FIG. 2, the engine case assembly 36 generally includes a plurality of modules, including a fan case module 60, an intermediate case module 62, a Low Pressure Compressor (LPC) module 64, a High Pressure Compressor (HPC) module 66, a diffuser module 68, a High Pressure Turbine (HPT) module 70, a mid-turbine frame (MTF) module 72, a Low Pressure Turbine (LPT) module 74, and a Turbine Exhaust Case (TEC) module 76. It should be understood that additional or alternative modules might be utilized.

Figure 3:
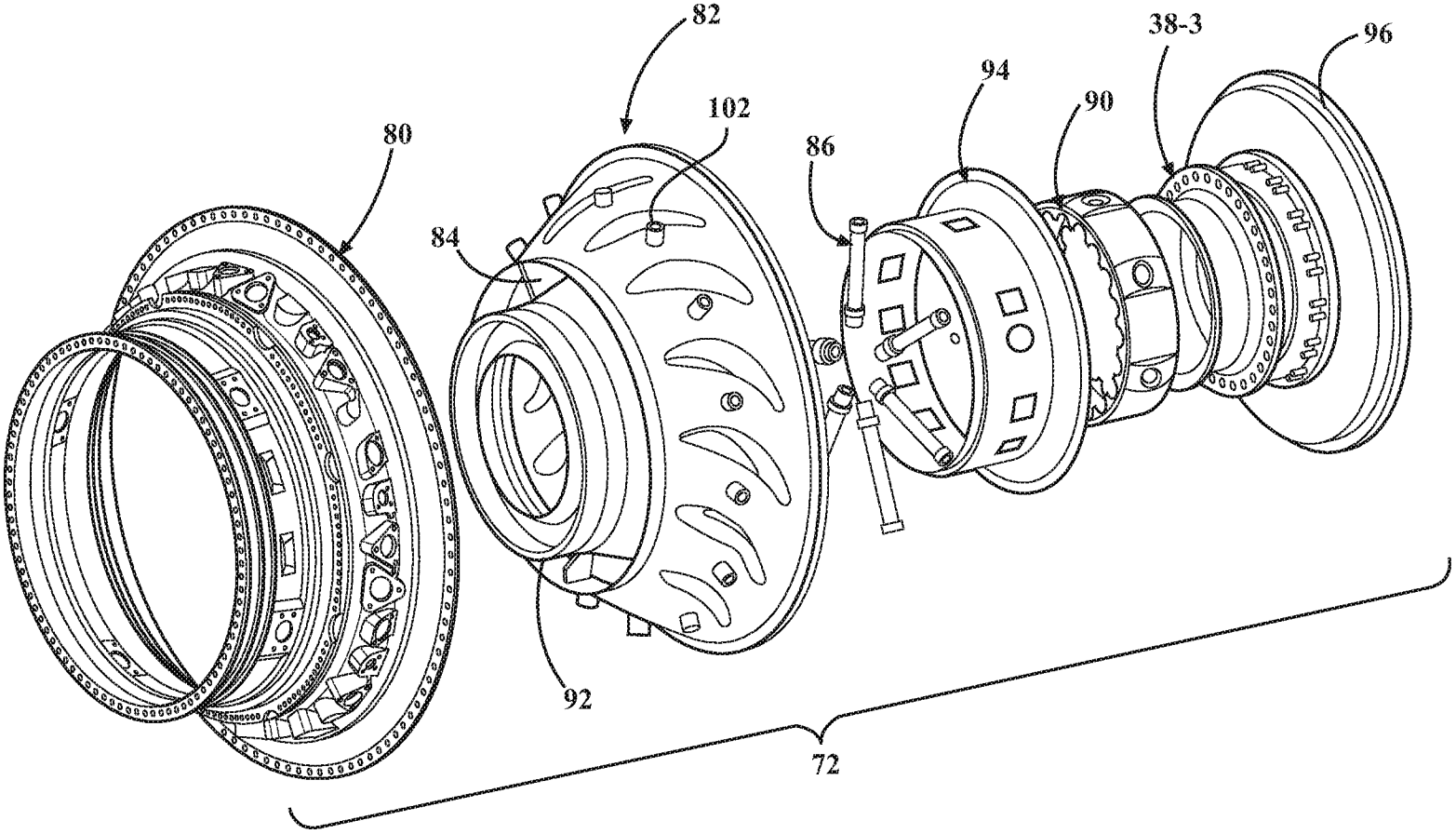
FIG. 3 is an exploded view of a Mid-Turbine Frame module.
Figure 4:
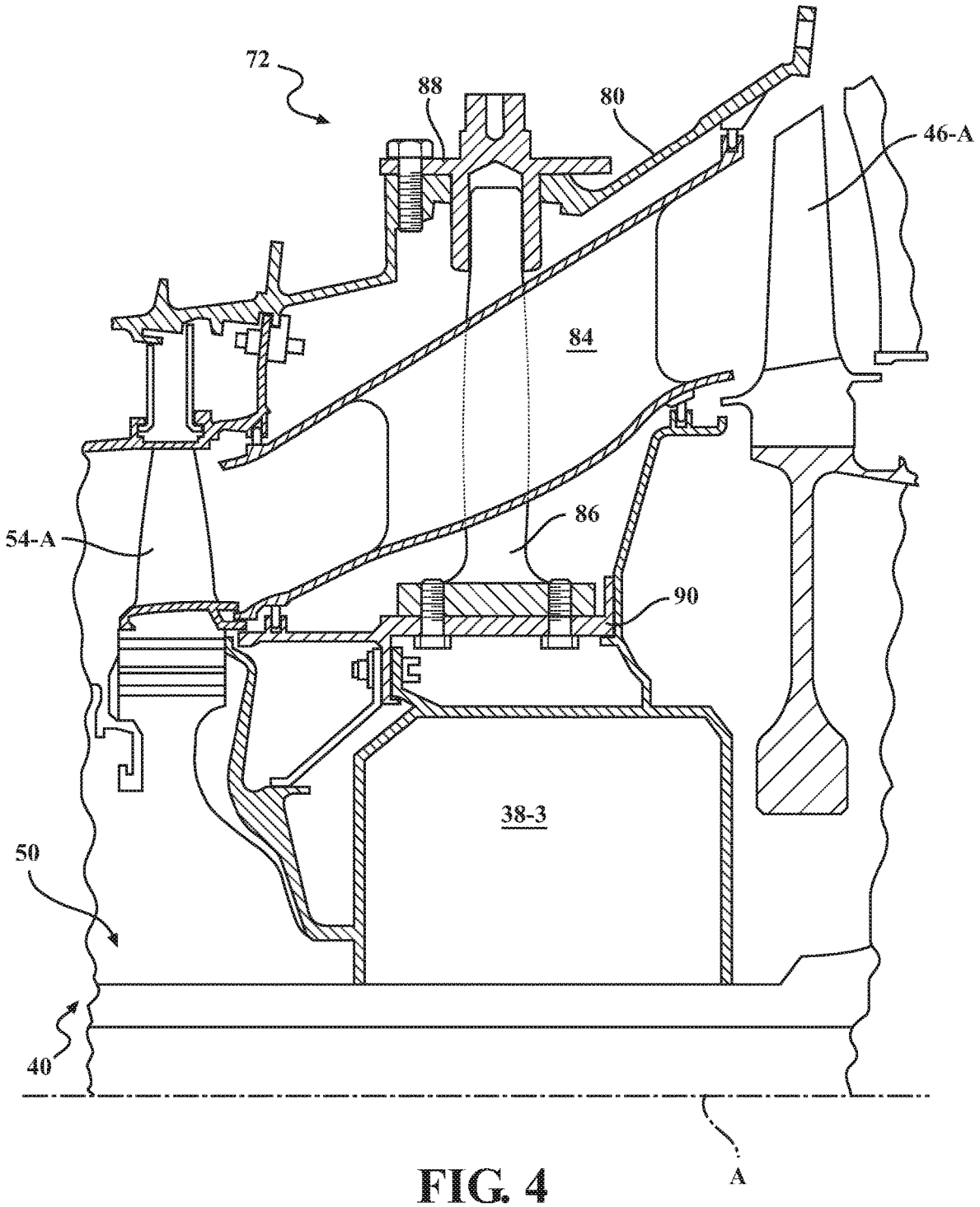
FIG. 4 is a cross-sectional view of the Mid-Turbine Frame module through a tie-rod.

With reference to FIG. 3, the MTF module 72, in this example, generally includes an outer MTF case 80, a mid-turbine frame (MTF) 82 with a multiple of hollow vanes 84, a multiple of tie rods 86, a multiple of tie rod nuts 88, an inner case 90, a HPT seal 92, a heat shield 94, a LPT seal 96, a multiple of centering pins 98, and a borescope plug assembly 100. The MTF module 72 supports the mid-bearing compartment 38-3 through which the inner and outer shafts 40, 50 are rotationally supported (FIG. 4). It should be appreciated that various other components may additionally or alternatively be provided within the MTF 82, for example only, the LPT seal 96 may alternatively be referred to as an intermediate seal in other engine architectures.

Each of the tie rods 86 are mounted to the inner case 90 and extend through a respective vane 84 to be fastened to the outer MTF case 80 with the multiple of tie rod nuts 88 that are at least partially received into a respective feature 89 formed in the outer MTF case 80. That is, each tie rod 86 is typically sheathed by a vane 84 through which the tie rod 86 passes (FIG. 4). The other vanes 84 may alternatively or additionally provide other service paths. The multiple of centering pins 98 are circumferentially distributed between the vanes 84 to engage bosses 102 on the MTF 82 to locate the MTF 82 with respect to the inner case 90 and the outer MTF case 80. It should be understood that various attachment arrangements may alternatively or additionally be utilized.

Figure 5:
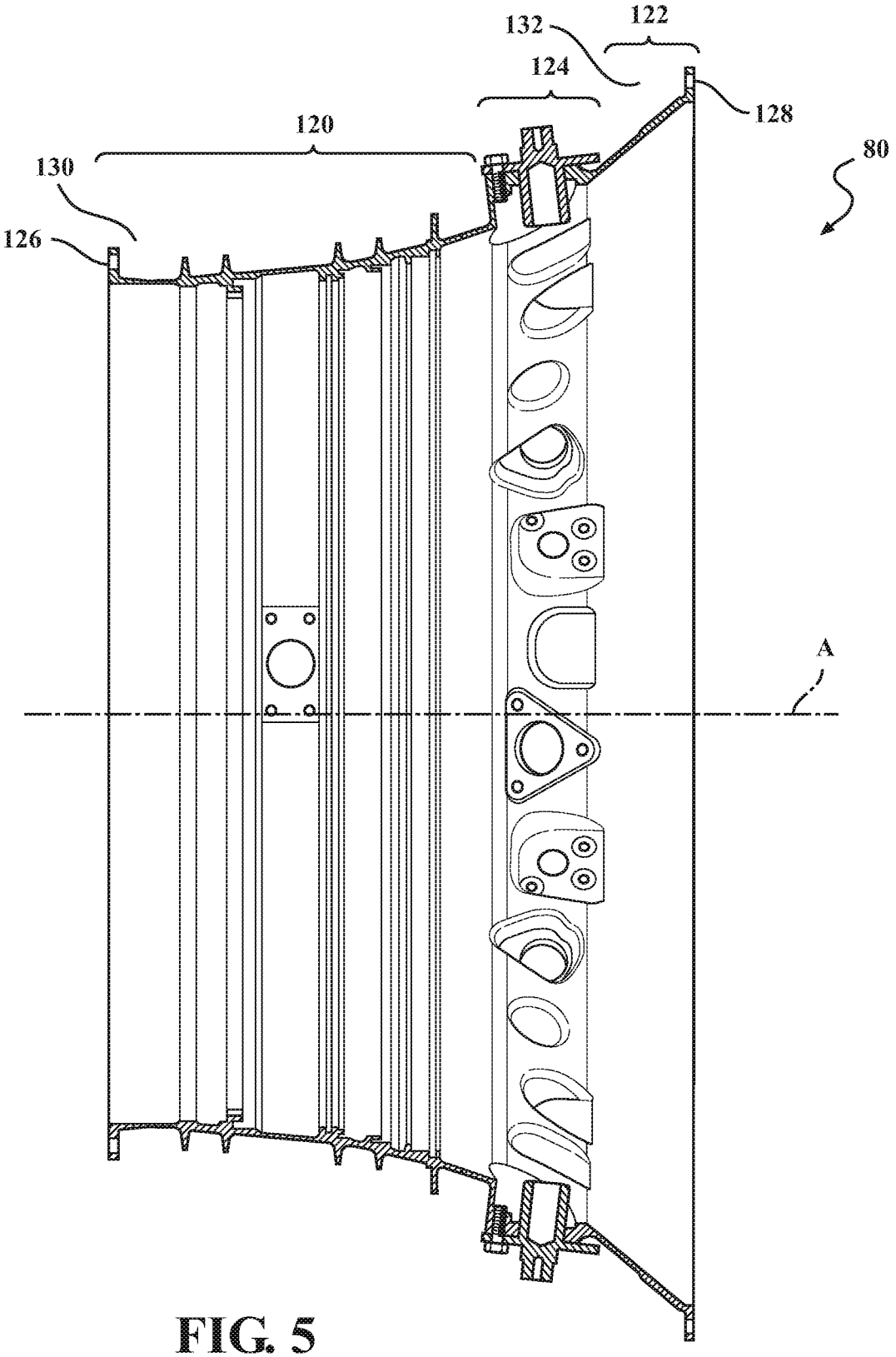
FIG. 5 is a side view of an outer MTF case of the Mid-Turbine Frame.

With reference to FIG. 5, the outer MTF case 80 is manufactured in a multiple of sections, here identified as a forged forward case section 120, an forged aft case section 122, and a cast case section 124 that is welded therebetween. The forged forward case section 120, the forged aft case section 122, and the cast case section 124 are defined around the engine axis A. In this example, the material of the sections 120, 122, 124 may include an age-hardened Inconel such as 718.

It should be appreciated that casting is the process where metal is heated until molten, then, while in the molten or liquid state, it is poured into a mold or vessel to create a desired shape. Casting facilitates manufacture of components that are relatively large, complicated, intricate or otherwise unsuitable for the forging process. In contrast, forging is the application of thermal and mechanical energy to steel billets or ingots to cause the material to change shape while in a solid state. Forging offers uniformity of composition and structure. Forging results in metallurgical recrystalisation and grain refinement as a result of the thermal cycle and deformation process. This strengthens the resulting alloy particularly in terms of impact and shear strength.

The forged forward case section 120 and the forged aft case section 122 each include a respective interface flange 126, 128 that permits the outer MTF case 80 to be fastened to respective forward and aft engine cases e.g. the diffusion module 68 and the TEC module 76 (FIG. 2). In this example, the outer MTF case 80 may at least partially form the High Pressure Turbine (HPT) module 70 and the Low Pressure Turbine (LPT) module 74.

The forged forward case section 120 and the forged aft case section 122 at least partially form containment zones 130, 132 for at least one rotor of the respective HPT 54 and the LPT 46. That is, the forged forward case section 120 and the forged aft case section 122 are located radially outboard of at least the last rotor 54-A (FIG. 4) of the HPT 54 and the first rotor 46-A (FIG. 4) of the LPT 46 to contain a blade-out incident. Blade-out requirements are readily provided for by the higher impact properties typical of a forged structure.

Figure 6:
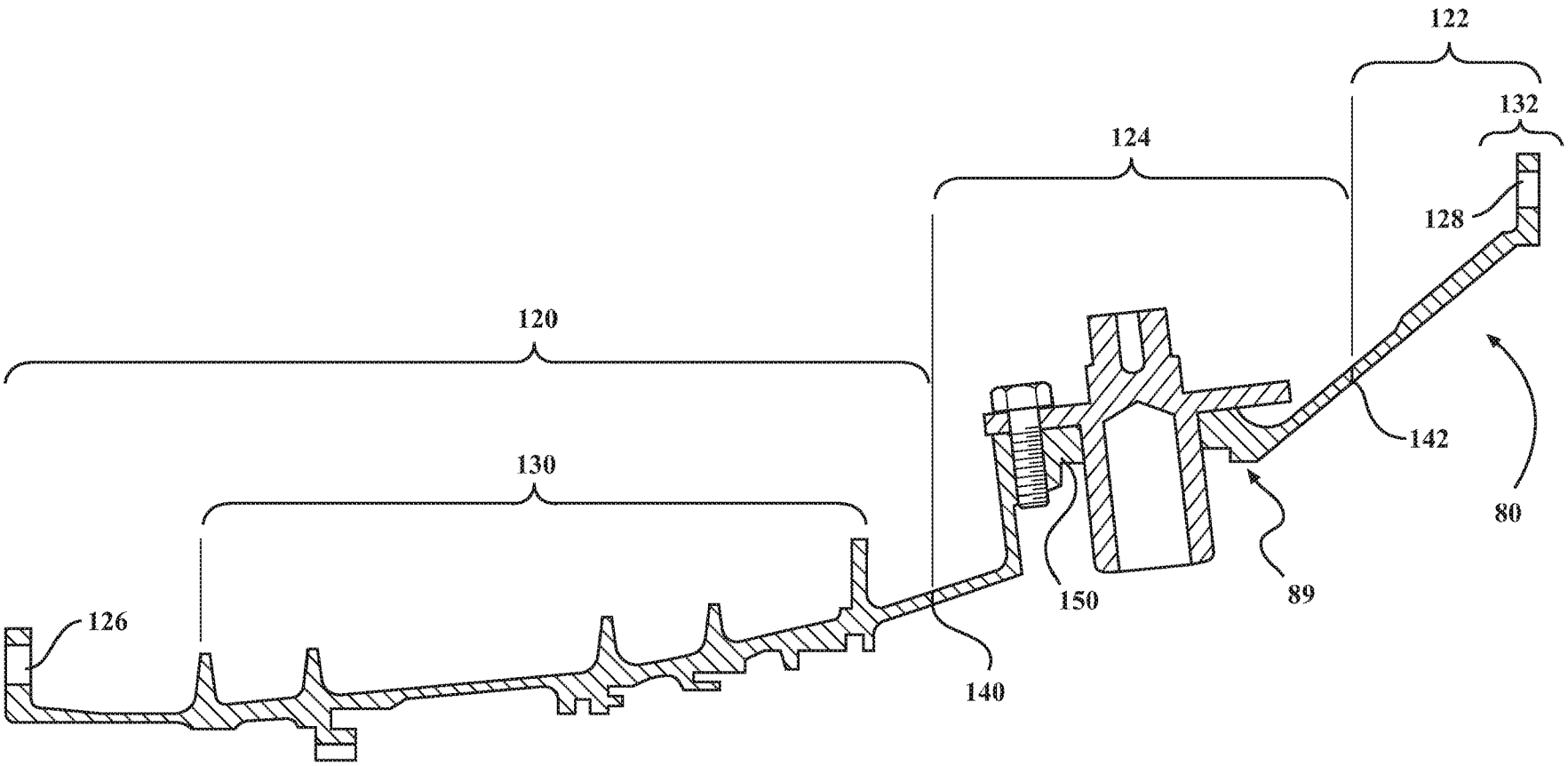
FIG. 6 is a cross-sectional view of an outer MTF case of the Mid-Turbine Frame.

With reference to FIG. 6, forward weld 140 is located between the forged forward case section 120 and the cast case section 124 outside of the containment zone 130 while an aft weld 142 between the cast case section 124 and the forged aft case section 122 outside of the containment zone 132. That is, the welds 140, 142 are located outside of the containment zones. The welds 140, 142 may also be non-machined welds to avoid exposing indications.

Figure 7:
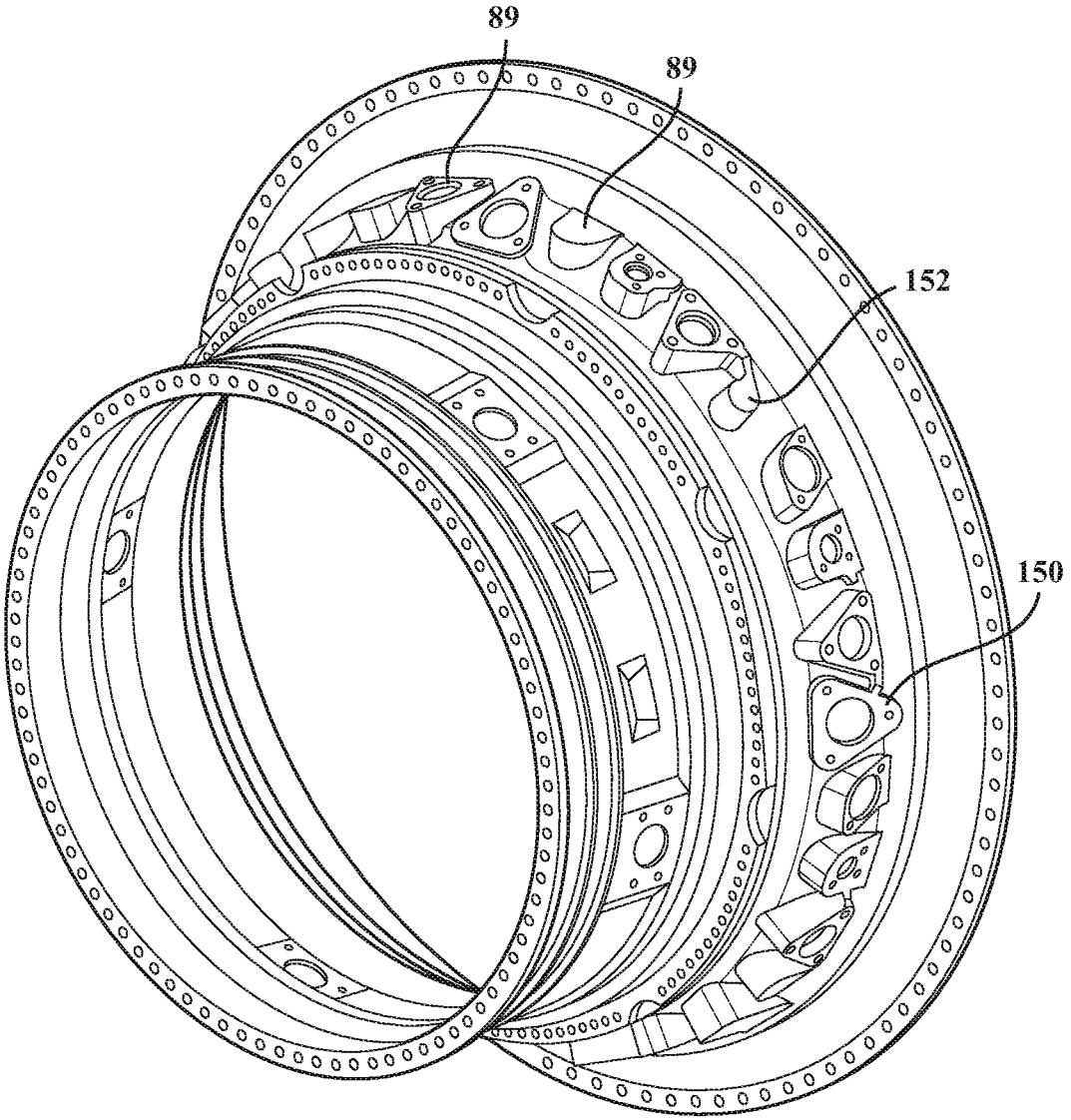
FIG. 7 is a perspective view of the outer MTF case of the Mid-Turbine Frame module.

The cast case section 124 forms the multiple of features 89 such as raised bosses 150 (FIG. 7) and other features that are formed thereby. At least some of the features 89 may be "dummy" features 152 to provide equivalent circumferential feature distribution to maintain equivalent thermal expansion about the entire periphery. That is, the "dummy" feature 152 does not provide an interface but merely balances other interface features located, for example, one hundred eighty degrees around the cast case section 124.

Figure 8:
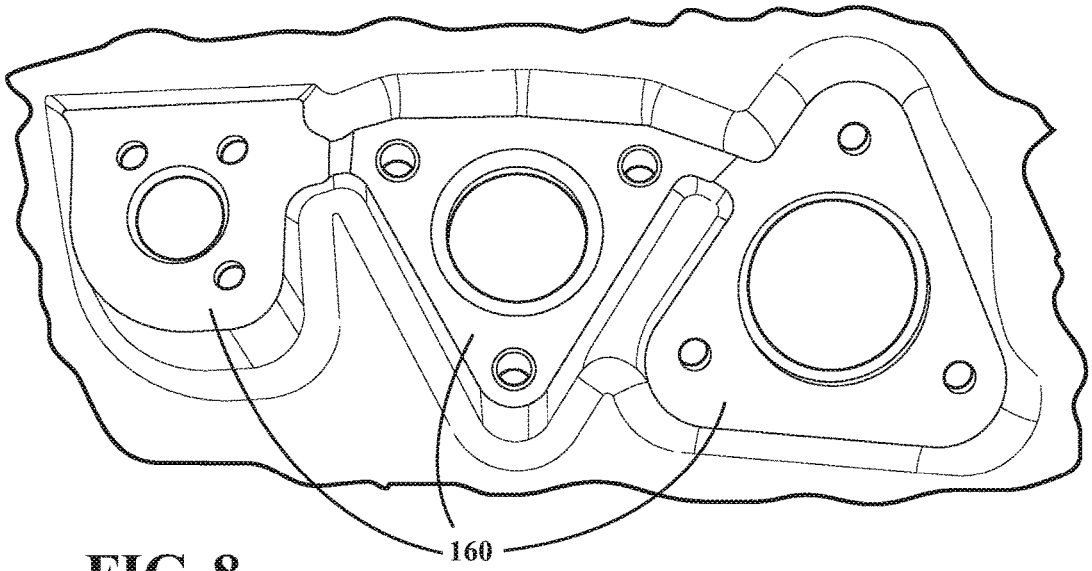
FIG. 8 is an expanded view of machined surfaces of the cast case section of the outer MTF case exterior.
Figure 9:
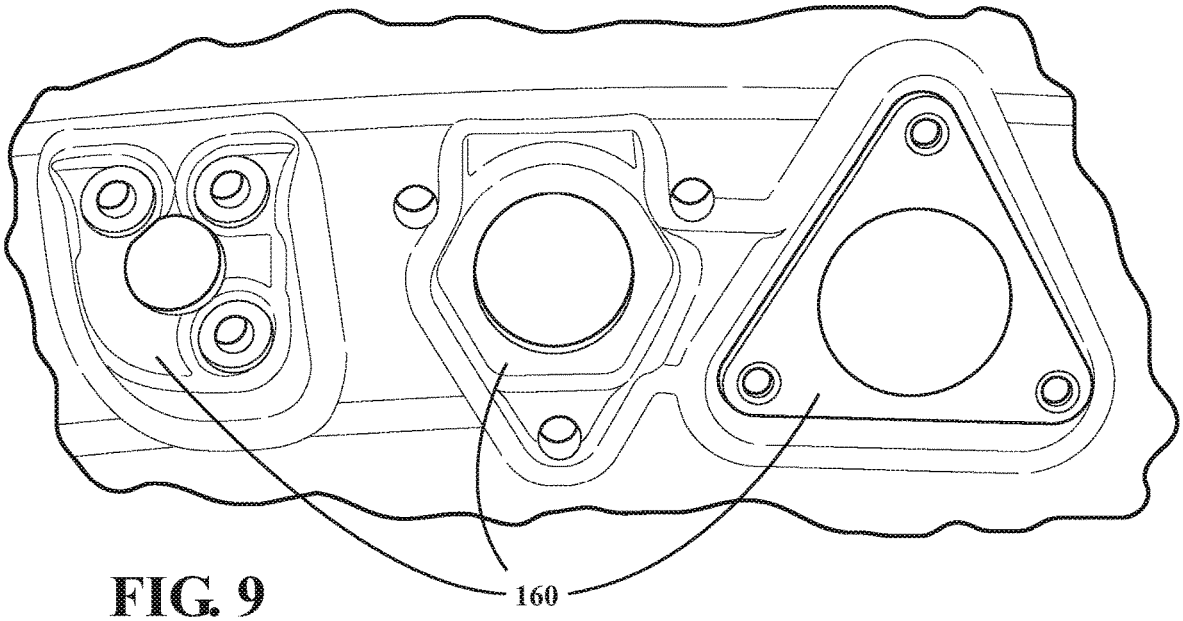
FIG. 9 is an expanded view of machined surfaces of the cast case section of the outer MTF case interior.

The relative complexity of the cast case section 124 due to the multiple of features 89 defined thereby is readily applicable to casting. That is, the cast case section 124 is cast to an essentially final shape that requires but minimal machining (FIGS. 8 and 9). The relative minimal machining of the features 89 may, for example, only require that a machined surface 160 (FIGS. 8 and 9) formed for attachment of various connections, sensors, and other devices such as the tie rod nut 88.

The cast case section 124, being casted rather than forged, facilitates relatively large, compound, fillets and/or blended fillets. The relatively large, compound, fillets are also readily easily cast which otherwise required cutter access between features 89 such as adjacent bosses 150. Conversely, relatively small fillets are readily cast to decrease weight. Casting thus results in a relatively lighter weight and easier to manufacture structure rather than a forged area that may require relatively more significant all around machining to reduce weight.

The material of the cast case section 124 may include an age-hardened Inconel such as 718 that is of a lower strength than that of the forged forward case section 120 and the forged aft case section 122 which are also manufactured of 718. Since no rotational hardware is located inboard of the cast case section 124, the cast case section 124 may provide the relatively lower impact properties typical of a cast structure. In this example, the material of the cast case section 124 may include an age-hardened Inconel such as 718 that is of a lower strength than that of the forged forward case section 120 and the forged aft case section 122.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An outer mid-turbine frame case for a gas turbine engine, comprising:

a forged forward case section that defines a forward containment zone around an axis, said forged forward case section configured for containment of a high pressure turbine rotor stage to contain a blade-out incident;

a forged aft case section that defines an aft containment zone around said axis, said forged aft case section configured for containment of a low pressure turbine rotor stage to contain a blade-out incident; and a cast case section around said axis, said cast case section comprises a forward machined interface to receive said forged forward case section and an aft machined interface to receive said forged aft case section, said cast case section welded to said machined interface of said forged forward case section at a forward weld outside of the forward containment zone and said cast case section welded to said machined interface of said forged aft case section at an aft weld outside of the aft containment zone, the area between the forward weld and the aft weld does not form a containment zone.

2. The outer mid-turbine frame case as recited in claim 1, further comprising a multiple of features that extend from the cast case section.

3. The outer mid-turbine frame case as recited in claim 2, wherein at least one of said multiple of features is a "dummy" feature.

4. The outer mid-turbine frame case as recited in claim 3, wherein said "dummy" feature does not provide an interface.

5. The outer mid-turbine frame case as recited in claim 4, wherein said "dummy" feature is one hundred eighty degrees around the cast case section opposite a raised boss.

6. The outer mid-turbine frame case as recited in claim 2, wherein at least one of said multiple of features comprises a machined surface.

7. The outer mid-turbine frame case as recited in claim 6, wherein at least one of said multiple of features comprises a boss with a machined surface.

8. The outer mid-turbine frame case as recited in claim 1, wherein said cast case section is manufactured of a lower strength but equivalent alloy of said forged forward case section and said forged aft case section.

9. The outer mid-turbine frame case as recited in claim 1, wherein an interface for the forward weld between the forged forward case section and the cast case section is a facial relationship.

10. The outer mid-turbine frame case as recited in claim 9, wherein an interface for the aft weld between the forged forward case section and the cast case section is a facial relationship.

11. The outer mid-turbine frame case as recited in claim 1, further comprising a forward interface flange that extends from said forged forward case section to permit said mid-turbine frame case to be fastened to a diffusion module.

12. The outer mid-turbine frame case as recited in claim 1, further comprising an aft interface flange that extends from said forged aft case section to permit said mid-turbine frame case to be fastened to a turbine exhaust case module.

13. The outer mid-turbine frame case as recited in claim 1, wherein said cast case section contains Inconel 718.

14. The outer mid-turbine frame case as recited in claim 1, wherein said welds are not machined.

15. The outer mid-turbine frame case as recited in claim 1, further comprising: a multiple of tie rods fastened to the outer mid-turbine frame case with a respective tie rod nut that are at least partially received into one of a multiple of respective feature formed in the outer mid-turbine frame case.

16. The outer mid-turbine frame case as recited in claim 1, further comprising: a multiple of tie rods mounted to an inner case, each of the multiple of tie rods extend through one respective vane of a mid-turbine frame, the multiple of tie rods fastened to the outer mid-turbine frame case with a respective tie rod nut that are at least partially received into one of a multiple of respective feature formed in the outer mid-turbine frame case.

* * * * *